US008905300B2

(12) United States Patent
Fumanelli

(10) Patent No.: US 8,905,300 B2
(45) Date of Patent: Dec. 9, 2014

(54) CASH DISPENSER, ATM AND THE LIKE

(71) Applicant: Giuseppe Ezio Fumanelli, Melzo (IT)

(72) Inventor: Giuseppe Ezio Fumanelli, Melzo (IT)

(73) Assignee: M.I.B. S.R.L., Milan (IT)

( * ) Notice: Subject to any disclaimer, the term of this patent is extended or adjusted under 35 U.S.C. 154(b) by 0 days.

(21) Appl. No.: 13/787,508

(22) Filed: Mar. 6, 2013

(65) Prior Publication Data

US 2013/0256332 A1 Oct. 3, 2013

(30) Foreign Application Priority Data

Apr. 3, 2012 (IT) ..... MI2012A0538

(51) Int. Cl.
*G07F 19/00* (2006.01)

(52) U.S. Cl.
CPC ..... *G07F 19/203* (2013.01); *G07F 19/201* (2013.01)
USPC ..... 235/379

(58) Field of Classification Search
USPC ..... 235/379; 109/64
See application file for complete search history.

(56) References Cited

U.S. PATENT DOCUMENTS

| | | | | |
|---|---|---|---|---|
| 7,344,065 | B1 | 3/2008 | Graef | |
| 2002/0011431 | A1 | 1/2002 | Graef et al. | |
| 2009/0277362 | A1 * | 11/2009 | Fumanelli | 109/64 |

FOREIGN PATENT DOCUMENTS

| | | | |
|---|---|---|---|
| EP | 1 073 026 | A1 | 1/2001 |
| WO | 01/22314 | A1 | 3/2001 |

OTHER PUBLICATIONS

The Search Report and Written Opinion issued for Italian Patent Application No. MI20120538, seven pages, completed on Jun. 25, 2012.

* cited by examiner

*Primary Examiner* — Daniel Hess
(74) *Attorney, Agent, or Firm* — Vorys, Sater, Seymour and Pease LLP; Susanne M. Hopkins

(57) ABSTRACT

Provided is a cash dispenser, ATM and the like (1) including: a safe (2) for banknotes and valuables, an outer face (3), a dispensing duct (4) for the banknotes and valuables, comprising a dispensing mouth (5) opening on the outer face (3), an inner opening (6) facing the inside of the safe (2), an elongated body (7) defining a passage between the dispensing mouth (5) and the inner opening (6), a conveying device (10), movable along the elongated body (7) and configured to convey said banknotes and valuables, and sensor means (20) of external stresses acting on the conveying device (10).

11 Claims, 5 Drawing Sheets

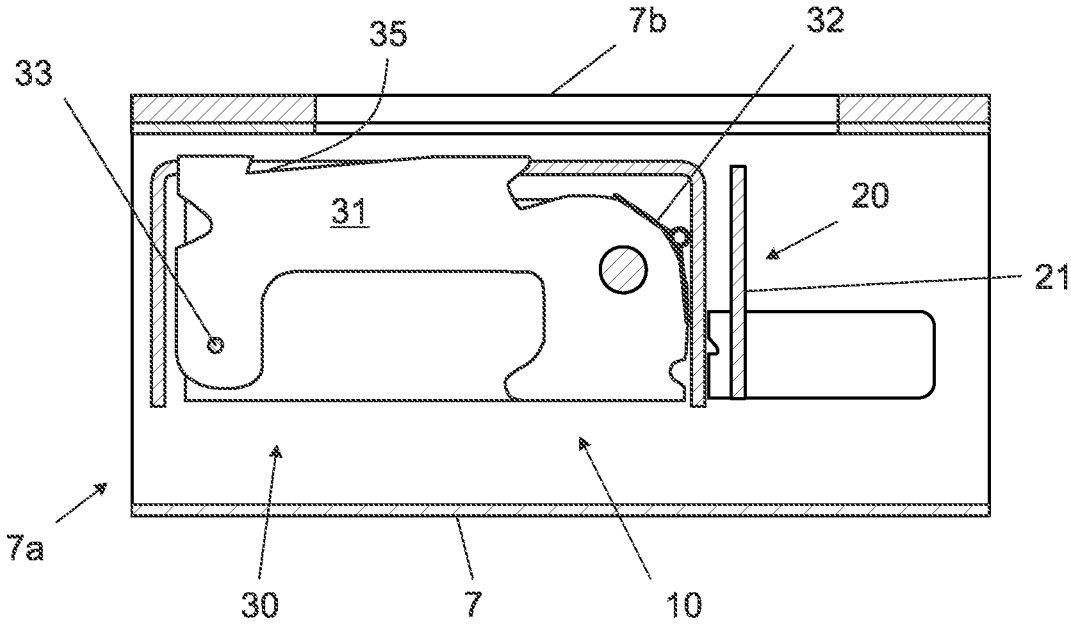
*Fig. 2a*
*Fig. 2b*
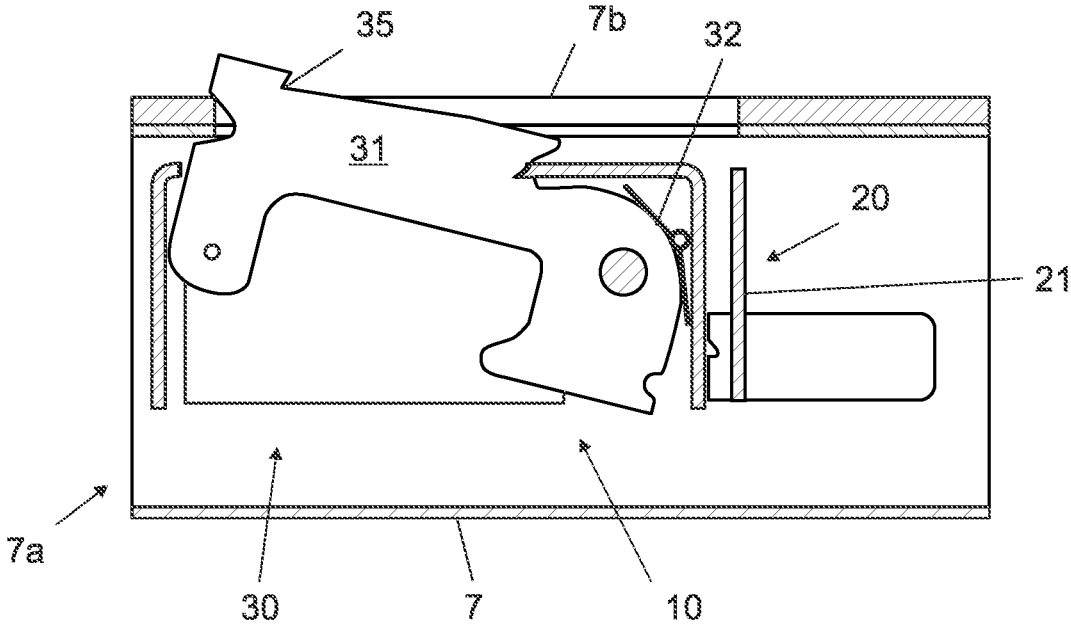

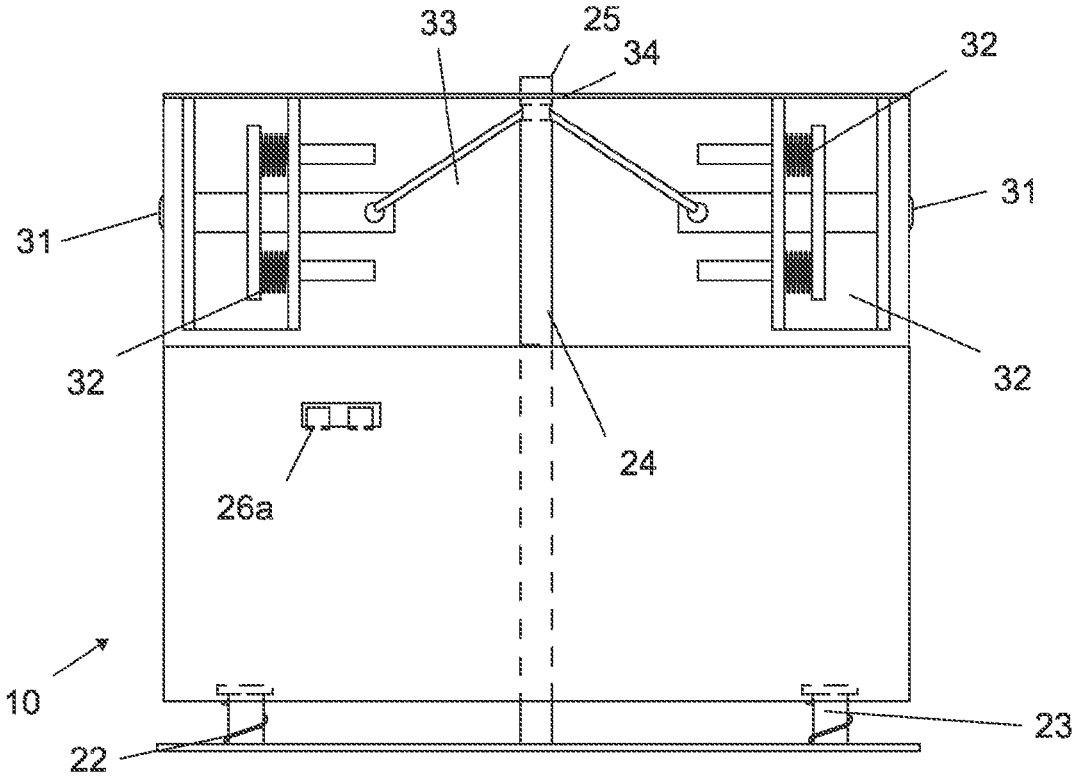
*Fig. 3a*
*Fig. 3b*
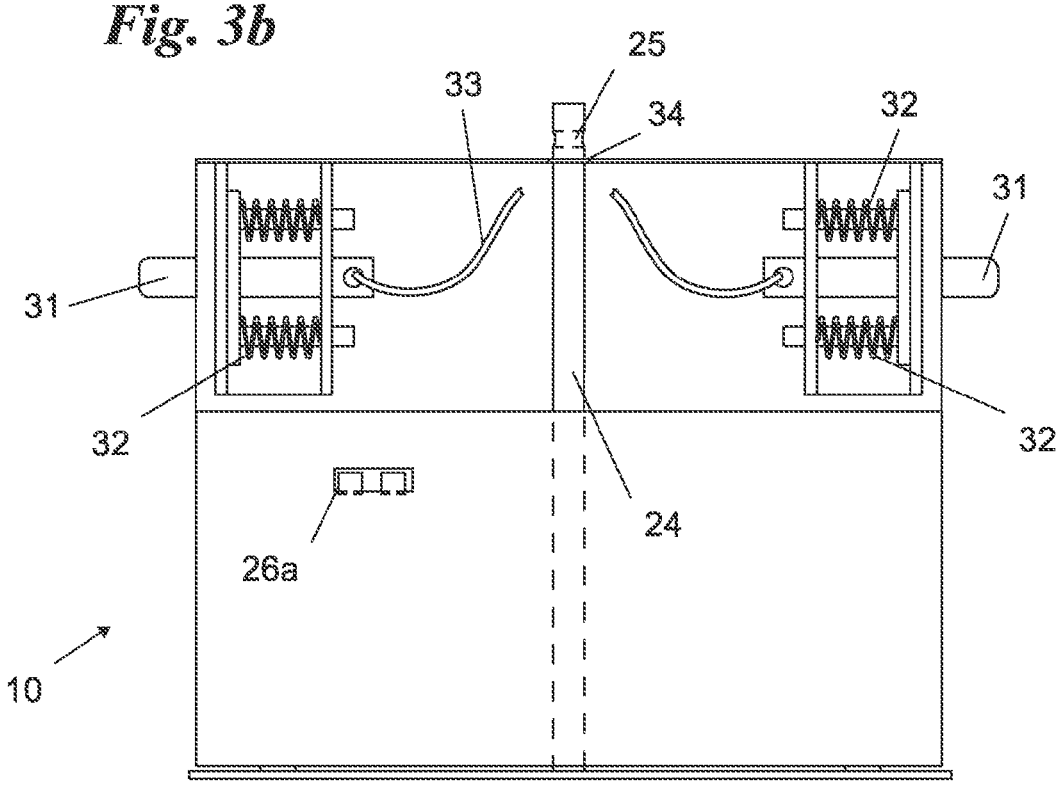

CASH DISPENSER, ATM AND THE LIKE

TECHNICAL BACKGROUND OF THE INVENTION

The present invention relates to a cash dispenser, ATM and the like of the type comprising: a safe for banknotes and valuables, an outer face, a dispensing duct for said banknotes and valuables, comprising a dispensing mouth opening on said outer face, an inner opening facing the inside of said safe, an elongated body defining a passage between said dispensing mouth and said inner opening, a conveying device, movable along said elongated body and suitable to convey said banknotes and valuables.

DESCRIPTION OF THE PRIOR ART

Dispensers of banknotes or valuables, such as in particular cash dispensers or ATMs or dispenser and deposit systems of bank notes are currently known. They comprise a safe suitable to contain banknotes and valuables and control means suitable to supply banknotes and valuables to an authorised user. The supply of banknotes and valuables takes place after recognition of the user by means of a badge or the like, and is performed through a dispensing mouth communicating with the inside of the safe and suitable to dispense bank notes and valuables to the user outside.

The dispensing mouths generally face public areas accessible to users. They are part of a dispensing duct further comprising an elongated body for the bank notes and valuables protruding from the safe by approximately half a meter and facing both the inside of the safe, where the bank notes and valuables are stored, and the outside of the cash dispenser, ATM or the like. In fact, said elongated body has, in correspondence with the outer exposed face of the cash dispenser, a slit or the like, through which the bank notes and valuables pass, usually gathered into wads.

The dispensing ducts further comprise a conveying device composed of a box-like element guided by moving belts and suitable to push the banknotes along the elongated body in the direction of the outer mouth.

In particular in the case of cash dispensers or ATMs this movement and dispensing mode of the banknotes is efficient and extremely widespread.

These have a drawback however: they allow the introduction of explosive substances through the dispensing mouth of the automatic distributor.

One of the possible attempts at breaking into the armoured casings of automatic banknote dispensers consists in fact of inserting therein a fluid, powder or in any case an explosive substance directly into the safe through the dispensing mouth, such fluid being then made to explode so as to open the safe from the inside and thereby make the bank notes and valuables contained therein accessible.

In particular criminals equip themselves with special implements of a greater length than the elongated body and of dimensions suitable to withstand the explosive. Such implements are suitable for being inserted inside the safe by crossing: the outer mouth, the entire elongated body and the inner aperture of the dispensing duct, to take the explosive inside the safe and detonate it.

To remedy such drawback several apparatuses have been developed which comprise a protective mechanical barrier suitable to prevent the introduction of gas inside the dispensing mouth. Such protective barrier must therefore open at the moment of dispensing the bank notes and valuables.

However at the moment of dispensing the bank notes or valuables the mouth remains open and thus subject to the possible introduction of explosive substances. The barriers and protective devices according to the prior art are thus unable to provide continuous protection.

SUMMARY OF THE INVENTION

In this situation the technical purpose of the present invention is to devise a cash dispenser, ATM or the like able to substantially overcome the drawbacks mentioned above.

Within the sphere of said technical purpose one important aim of the invention is to prevent the insertion and detonation of explosives, described above, through the dispensing mouth.

The technical purpose and specified aims are achieved by a cash dispenser, ATM and the like comprising: a safe for banknotes and valuables, an outer face, a dispensing duct for said banknotes and valuables, comprising a dispensing mouth opening on said outer face, an inner opening facing the inside of said safe, an elongated body defining a passage between said dispensing mouth and said inner opening, a conveying device, movable along said elongated body and suitable to convey said banknotes and valuables, sensor means detecting external stresses acting on said conveying device and a safety system operatively connected to said sensor means and comprising blocking elements, suitable to block said conveying device and to prevent at least partially the movement thereof.

BRIEF DESCRIPTION OF THE DRAWINGS

The characteristics and advantages of the invention are clearly evident from the following detailed description of a preferred embodiments thereof, with reference to the accompanying drawings, in which:

FIG. 2*a* shows a first embodiment of a detail of the cash dispenser, ATM or the like according to the invention in a side view and in a first configuration;

FIG. 2*b* shows the detail in FIG. 2*a* in a second configuration;

FIG. 3*a* shows a different embodiment of the detail in FIG. 2*a* seen from above and in a first configuration;

FIG. 3*b* shows the detail in FIG. 3*a* seen from above and in a second configuration;

DETAILED DESCRIPTION OF THE PREFERRED EMBODIMENTS

Figure 1A:
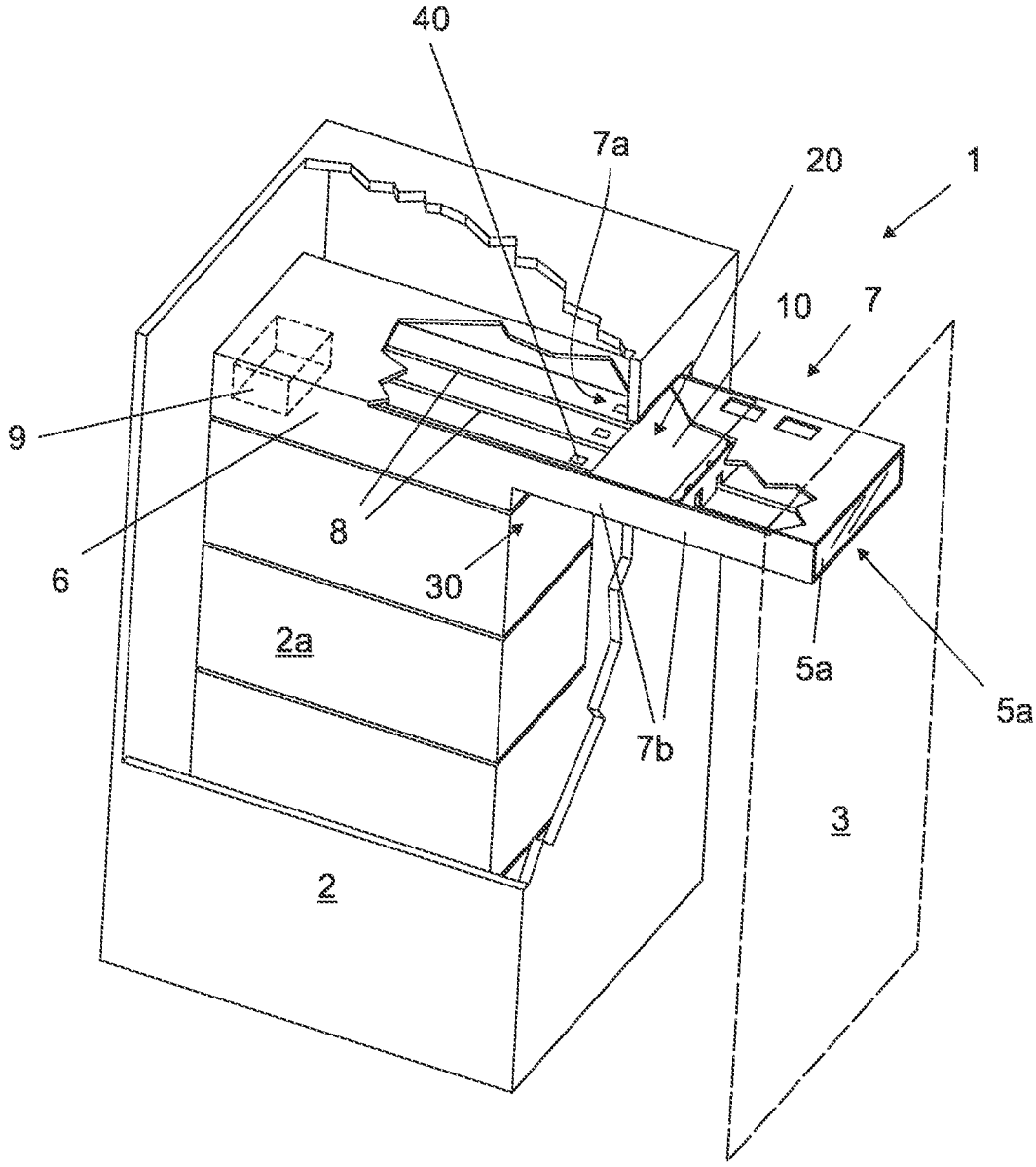
FIG. 1*a* shows a cash dispenser, ATM or the like according to the invention in a first configuration.
Figure 1B:
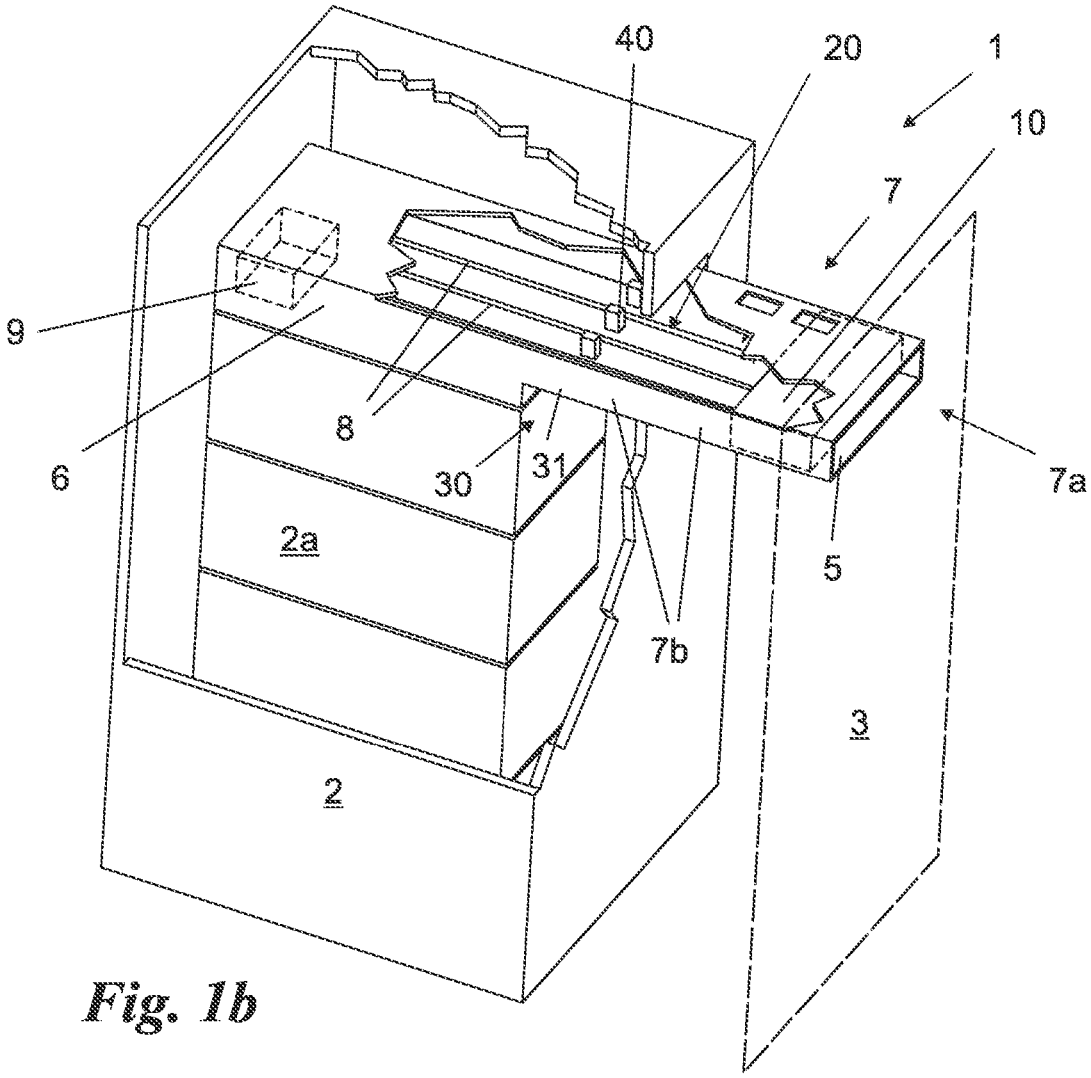
FIG. 1*b* shows a cash dispenser, ATM or the like according to the invention in a second configuration.

With reference to said drawings reference numeral 1 globally denotes the cash dispenser, ATM and the like according to the invention.

It comprises, in brief, a safe 2 for bank notes and valuables, an outer face 3 and a dispensing duct 4 suitable to convey the bank notes and valuables.

More specifically, the safe 2 is in itself known and comprises a drawer unit 2*a*, suitable to contain the various denominations of bank note. Moreover, the safe 2 is not placed in direct contact with the outer face 3, but is approximately half a meter away from it.

The outer face 3 comprises means of interacting with the public of the known type, such as a screen, a keypad, an insertion slit of a badge, and a slit for inserting and extracting bank notes and valuables described below and so forth.

The dispensing duct 4 is composed of the device which together connects the inside of the safe 2 to the outer face 3 and thus permits the user to take out valuables after their conveyance.

The dispensing duct 4 comprising, in brief: a dispensing mouth 5 which faces the outer face 3 and permits the bank notes and valuables to be taken out by a user, an inner opening 6 which faces the inside of the safe 2 and permits bank notes and valuables to be put into the dispensing duct 4 and an elongated body 7 defining a passage between the dispensing mouth 5 and the inner opening 6. The dispensing mouth 5 is, in addition, preferably fitted with an obturator 5*a*, suitable to obstruct said dispensing mouth 5 when the transit of bank notes and valuables through it is not envisaged.

More specifically, the elongated body 7 is a slimmed down parallelepiped of suitable dimensions to permit the transport of the bank notes and defining an inner channel 7*a*.

The elongated body 7 includes a conveying device 10, movable along said elongated body 7 and suitable to convey the bank notes and valuables.

It is preferably composed of a parallelepiped body and is moved by means of special movement belts 8 in turn operated by an electric motor.

The cash dispenser, ATM and the like 1 advantageously comprises sensor means 20 of external stresses acting on said conveying device 10.

In particular such sensor means 20 are suitable to detect stresses suitable for pushing from the outside towards the inside of the cash dispenser, ATM or the like with a force above a predetermined threshold to permit the introduction of material inside the cash dispenser, ATM or the like. Said threshold is set in such a way that when the conveying device pushes the bank notes and valuables the sensor means are not alerted.

Said sensor means 20 may be positioned on the conveying device itself 10, on the elongated body 7, or in other parts in that the entire bank note distributor is suspended and rests on guides of the cash dispenser 1.

They may, in addition, be suitable to verify the movement of the drawer unit 2*a* and of the connected elongated body 7 together with the conveying device 10, in relation to the safe 2.

The cash dispenser 1 further comprises a safety system 30, operatively connected to the sensor means 20. It too may be placed on said conveying device 10, on the elongated body 7 or in other parts of the dispenser 1. The safety system 30 thus substantially constitutes the actuator device of the sensor 20, and in some cases, especially in the essentially mechanical embodiments, the safety system and the sensor are incorporated in a single element or device, which is thus sensor and actuator at the same time.

More specifically, in a first embodiment, the sensor means 20 are composed of a movable element 21 placed on the front face, that is the face facing towards the dispensing mouth 5, of the conveying device 10 and suitable to move following stresses in the direction of the inner opening 6 or in the opposite direction.

The movable element 21 may consist of a movable plate, in particular in the case of a mechanical sensor 20, or of a push-button or similar mechanism, in particular in the case of an electromechanical mechanism or the like.

The safety system 30 comprises blocking elements 31, suitable to block the conveying device 10 and prevent its rearward movement or shift following a thrust from the outside towards the inside.

In fact, following activation of the sensor means 20 the blocking elements 31 block the conveying device 10 along the elongated body 7.

These may be positioned on board the conveying device 10 and suitable to emerge therefrom following the activation of the sensor means 20 to engage preferably in special safety seats 7*b* positioned on the elongated body 7.

In this case the blocking elements 31 are preferably kept in a non-blocking position and kept inside the conveying device 10 so as not to obstruct the movement thereof, by a safety element 33, suitable for being broken following stresses on the sensor means 20.

The safety element 33 preferably acts in contrast with elastic safety devices 32, suitable to position the blocking elements 31 in a blocking position of the conveying device 10 in the absence of said safety element.

The safety element 33 is preferably a wire placed in proximity of a cutting edge 34 or the like preferably directly connected to the movable element 21.

In a first specific example, illustrated in FIGS. 2*a* and 2*b*, the sensor means 20 comprise a movable element 21 preferably composed of a plate movable along the elongated body 7 in the direction of the inner opening 6 in contrast to elastic elements 22. It is in addition preferably connected by sleeves 23 to the device 10. The sensor means 20 are otherwise replaced by an electromechanical push-button or the like.

The movable element 21 is in addition connected to a rod 24 defining part of the safety system 30.

The latter comprises blocking elements 31 composed of tilting plates, positioned on board the conveying device 10 and suitable to emerge, pushed by the elastic safety devices 32, from the conveying device 10 to anchor to the upper or lower portion of the elongated body 7, comprising appropriate safety seats 7*b*. The blocking elements 31 composed of tilting plates further comprise notches 35, suitable for preventing the tilting thereof from outside, for example by means of a blade.

The blocking elements 31 are kept inside the conveying device 10 by means of the safety element 33 consisting of a wire.

The wire which forms the safety element 33 in fact constitutes a block to the rotation of the safety elements. Said wire is in addition preferably inserted in a seat 25, positioned in the rod 24 and in the proximity of the cutting edge 34, preferably composed of a hole exactly counter-shaped to the rod 24.

The cutting edge 34 may alternatively be replaced by a release system of two portions of the safety element 33 by a sacrificial glass or by a known system. In particular the cutting edge 34 is placed in the direction of the inner opening 6 of the dispensing duct 4.

Figure 4:
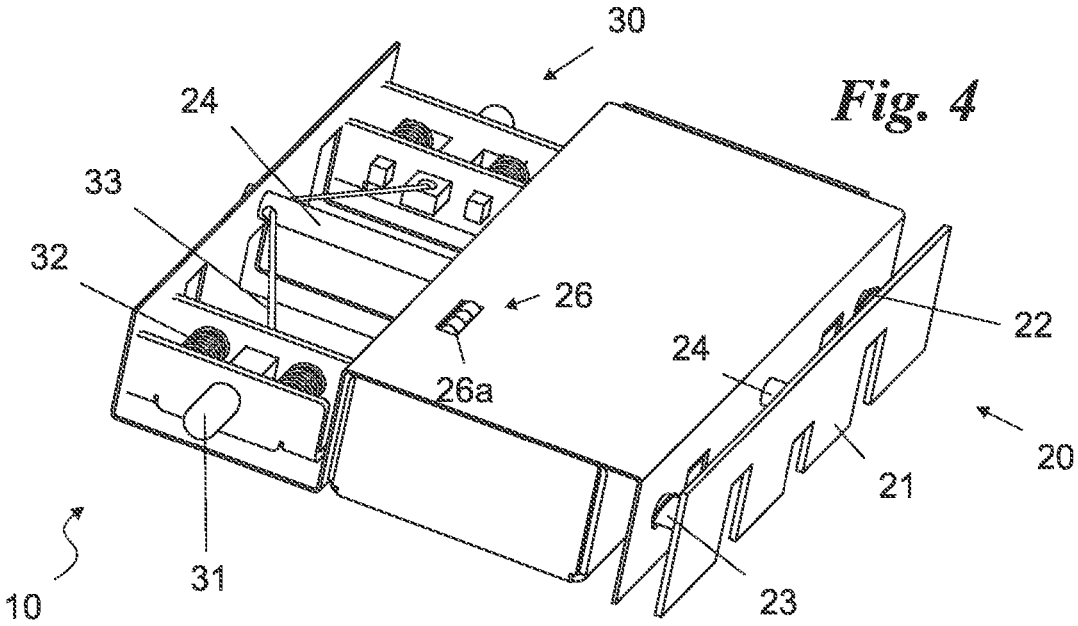
FIG. 4 shows the detail in FIGS. 3*a* and 3*b* in an axonometric view.

In a further specific example, shown in FIGS. 3*a*, 3*b* and 4 and very similar to the example in FIGS. 2*a* and 2*b*, the blocking elements 31 are composed of retractable pistons, positioned on the sides of the conveying device 10 and suitable to emerge, pushed by elastic safety devices 32, from the conveying device 10, to anchor to the sides of the elongated body 7 in the safety seats 7*b*.

In this case too the blocking elements 31 are kept inside the conveying device 10 by means of a safety element 33 consisting of a wire. The remaining part of the device is analogous to that relative to the embodiment in FIGS. 2*a* and 2*b*. In addition or alternatively, the blocking elements 31 may be positioned on the elongated body 7 and suitable to obstruct mechanically or electro-mechanically the inner channel 7*a* defined by the elongated body 7 following activation of the sensor means 20.

Second blocking elements 40 may also be present suitable to mechanically obstruct the inner channel 7*a* and suitable to be activated following the opening of the obturator 5*a* and to be mechanically connected to said obturator 5*a* in such a way that an opening of the obturator 5*a* automatically corresponds to a blocking of the second blocking elements 40.

Figure 5A:
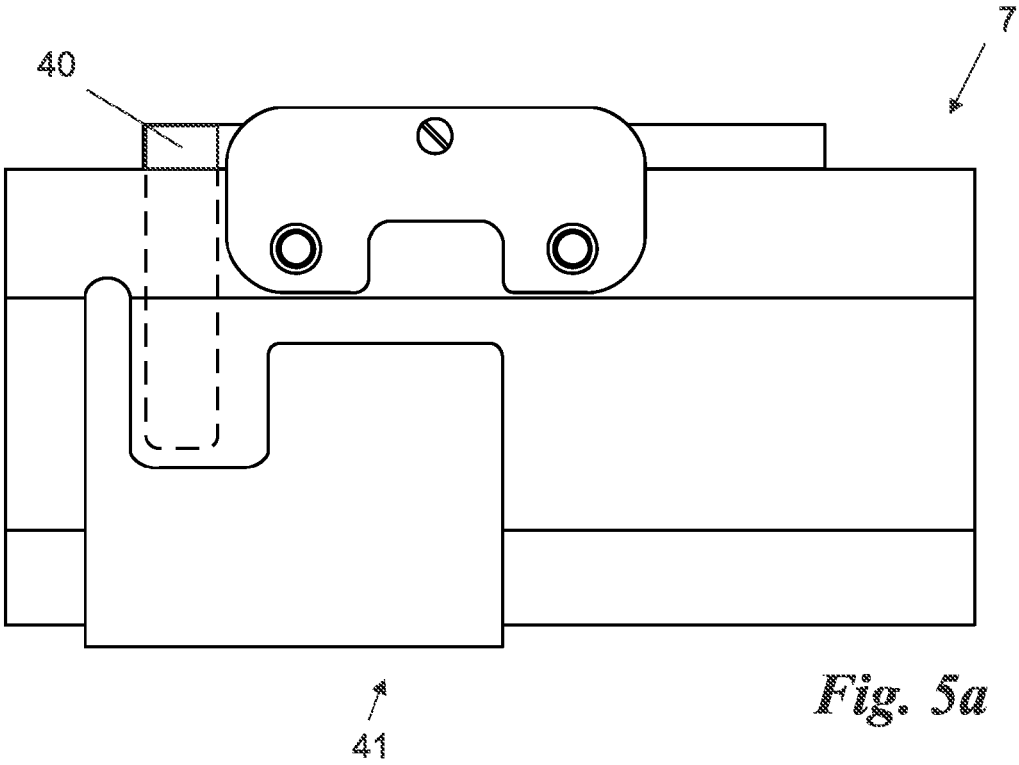
FIG. 5*a* shows a further portion of the cash dispenser, ATM or the like according to the invention in a side view and in a first configuration.
Figure 5B:
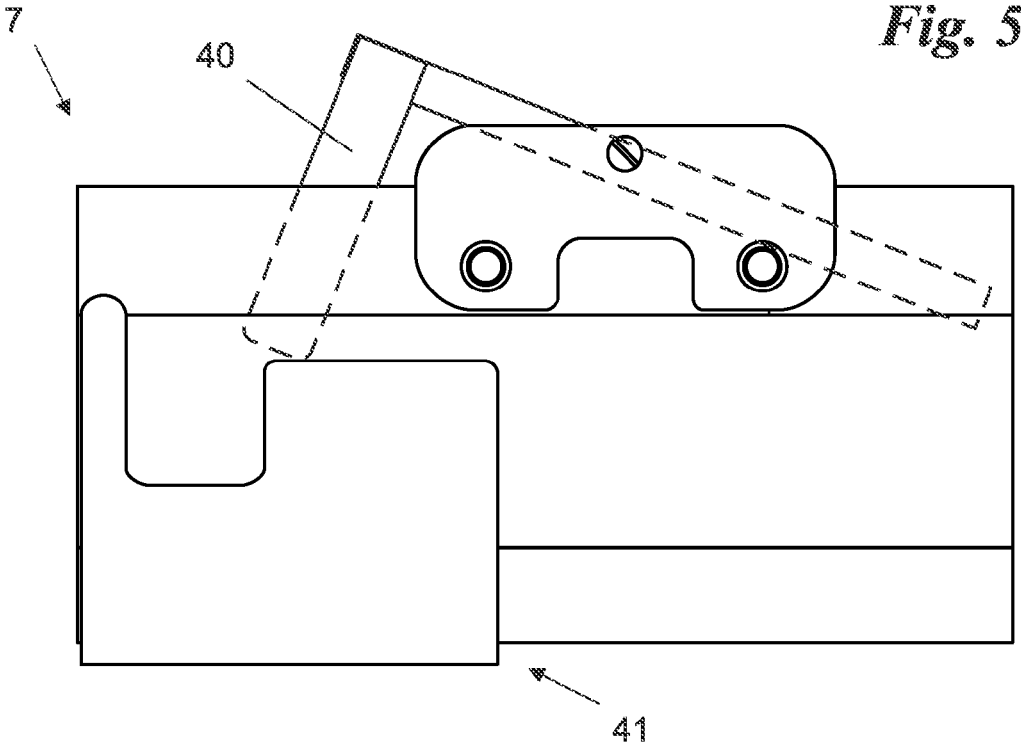
FIG. 5*b* shows the detail in FIG. 5*a* in a second configuration.

In particular the second blocking elements 40 are composed of two tilting blocks movable in contrast to elastic elements, as illustrated in FIGS. 5*a* and 5*b*.

In particular the obturator 5*a* is open following the advancement of a plate 41, in proximity of the elongated body 7 in particular below or above the same. The plate 41 further comprises abutments 42 integral with the blocks and suitable to rotate them into a blocking position of the elongated body 7 concurrently with the opening of the obturator.

The second blocking elements 40 thus prevent the device 10 from moving backwards if pushed from the outside and collaborate in the activation of the sensor 20 and the safety system 30.

In another example the sensor 20 comprises a movable element 21 composed of a push-button or similar mechanism, in particular in the case of an electro-mechanical system or the like operatively connected to a safety system 30 of the type described above.

Alternatively or in addition thereto, the cash dispenser comprises position sensors 26 which comprise a first portion 26*a* on the conveying device 10, such as a magnet or the like, and a second portion (not shown) along the elongated body 7.

The positions sensors 26 are connected to the cash dispenser 1 logic and are suitable to verify that the device 10 is not moved by the cash dispenser motor 9 but by external intervention.

In this example the safety system 30 may comprise alarms, bank note marking systems and so forth.

Said safety systems 30 and sensor means 20 can be summed, combined or added to further sensor means 20 such as accelerometers and the like.

The functioning of the cash dispenser, ATM and the like 1, described above in a structural sense, is as follows.

The cash dispenser 1 is used in a traditional manner by users and servicing personnel.

In particular users may request bank notes by interacting with the outer face 3 and take out the bank notes which are conveyed from the drawers 2*a* of the safe 2 to the dispensing mouth 5 by means of the dispensing duct 4 and in particular of the conveying device 10.

Should a criminal insert an implement through the dispensing mouth 5 and along the elongated body 7, the sensor means 20 would detect such insertion and activate the safety system 30, preventing the break-in. Moreover such insertion would need to take place with the obturator 5*a* open, and thus with the second blocking means obstructing the channel 7*a*. In such conditions the safety system 30 is even more likely to activate.

In particular said implement would push the movable portion 21 in the direction of the inner opening 6, pushing the rod 24 in the same direction, thus towards the cutting edge 34.

As a result the safety wire 33 would be cut by the cutting edge 34, or released by the release system or the sacrificial glass would be broken, and would release the pistons 31 which would pivot, pushed by the elastic safety elements 32, into the safety seats 7*b*, on the elongated body 7.

The device 10, which is appropriately armoured, thus constitutes a physical access barrier to the safe.

In addition the position sensors 26 verifying that such impulse is not commanded by the motor, would activate the safety systems 30, making the break-in futile and impossible and alerting the security forces.

The invention achieves some important advantages.

In fact the cash dispenser, ATM and the like 1, and the device 10 prevent break-ins by means of introducing explosive through the dispensing duct 10. Modifications and variations may be made to the invention described herein without departing from the scope of the inventive concept. All details may be replaced with equivalent elements and the scope of the invention includes all other materials, shapes and dimensions.

The invention claimed is:

1. A cash dispenser or ATM, comprising:

a safe for banknotes and valuables;

an outer face;

a dispensing duct for said banknotes and valuables, said dispensing duct comprising a dispensing mouth opening on said outer face;

an inner opening facing an inside of said safe;

an elongated body defining a passage between said dispensing mouth and said inner opening;

a conveying device movable along said elongated body and configured to convey said banknotes and valuables a sensor device for detecting external stresses acting on said conveying device, said sensor device comprising a movable element positioned on said face facing towards said dispensing mouth of said conveying device and configured to move following stresses in an outward direction to the cash dispenser of said inner opening; and a safety system operatively connected to said sensor device and comprising blocking elements configured to block said conveying device and to prevent at least partially movement of the conveying device.

2. The cash dispenser or ATM as claimed in claim 1, wherein said sensor device is configured to detect stresses pressing from said outside towards said inside of said cash dispenser or ATM, or in an opposite direction which would permit the introduction of explosive material inside said cash dispenser or ATM.

3. The cash dispenser or ATM as claimed in claim 1, wherein said blocking elements are positioned on board said conveying device and configured to emerge from the conveying device following activation of said sensor device to engage in safety seats.

4. The cash dispenser or ATM as claimed in claim 1, wherein said blocking elements are positioned on said elongated body and configured to mechanically obstruct the inner channel defined by the elongated body following activation of said sensor device.

5. The cash dispenser or ATM as claimed in claim 1, wherein said blocking elements are kept in a non-blocking position and kept inside said conveying device so as not to obstruct the normal movement of said conveying device, by a safety element, configured for being broken following external stresses on said sensor device.

6. The cash dispenser or ATM as claimed in claim 1, further comprising a safety element acting in contrast to elastic safety devices configured to position said blocking elements in a blocking position of said conveying device in the absence of said safety element.

7. The cash dispenser or ATM as claimed in claim 1, wherein said blocking elements comprise tilting plates positioned on board said conveying device and configured to emerge, pushed by elastic safety devices, from the conveying device, to anchor to said elongated body comprising safety seats.

8. The cash dispenser or ATM as claimed in claim 1, wherein said dispensing mouth comprises an obturator, and said cash dispenser further comprises second blocking elements configured to mechanically obstruct said inner channel and configured to activate following the opening of said obturator.

9. The cash dispenser or ATM as claimed in claim 8, wherein said second blocking elements comprise two tilting blocks movable in contrast to elastic elements.

10. The cash dispenser or ATM as claimed in claim 1, wherein said safety system comprises an alarm.

11. The cash dispenser or ATM as claimed in claim 1, wherein said safety system comprises a marking system.

* * * * *